US005531490A

United States Patent [19]

Parker

[11] Patent Number: 5,531,490

[45] Date of Patent: Jul. 2, 1996

[54] DOOR SECURITY DEVICE ALLOWING PARTIAL DOOR OPENING

[76] Inventor: Robert D. Parker, 2910 NE. 27th, Gresham, Oreg. 97030

[21] Appl. No.: 410,376

[22] Filed: Mar. 27, 1995

Related U.S. Application Data

[63] Continuation of Ser. No. 42,038, Apr. 1, 1993, abandoned.

[51] Int. Cl.[6] ..... E05F 5/00

[52] U.S. Cl. ..... 292/262; 16/82; 292/289; 292/DIG. 15

[58] Field of Search ..... 292/262, 268, 292/289, DIG. 15; 16/82; 49/394, 450

[56] References Cited

U.S. PATENT DOCUMENTS

| | | | |
|---|---|---|---|
| 635,432 | 10/1899 | Doyle, Jr. | 292/262 |
| 851,150 | 4/1907 | Younglove | 292/268 |
| 999,434 | 8/1911 | Cook | 292/268 |
| 1,218,366 | 3/1917 | Bried | 16/82 X |
| 1,618,353 | 2/1927 | Rice | 292/268 |
| 1,799,265 | 4/1931 | Unkelbach et al. | 292/262 |
| 2,189,274 | 2/1940 | Storrs, Jr. | 292/DIG. 15 X |
| 2,744,779 | 5/1956 | Ellis | 16/82 X |
| 3,690,709 | 9/1972 | Bogusz | 292/DIG. 15 X |
| 3,805,322 | 4/1974 | Serrano | 16/82 |
| 3,833,963 | 9/1974 | Waters | 16/82 |
| 3,980,331 | 9/1976 | Kennedy et al. | 292/268 |
| 4,142,752 | 3/1979 | Chilton | 292/343 |
| 4,469,359 | 9/1984 | Westbrooks | 292/288 |
| 4,601,502 | 7/1986 | Van Dyke | 292/252 |
| 4,631,776 | 12/1986 | King | 16/82 |
| 4,756,052 | 7/1988 | Diedrich | 16/82 |
| 4,867,493 | 9/1989 | Ward | 292/DIG. 15 X |
| 5,027,471 | 7/1991 | Barnes | 16/86 R |
| 5,123,205 | 6/1992 | Folkerts | 49/394 X |
| 5,244,273 | 9/1993 | Kaspar et al. | 16/82 X |
| 5,383,254 | 1/1995 | Wigley, Sr. | 16/82 |
| 5,454,143 | 10/1995 | Wigley | 16/82 |

FOREIGN PATENT DOCUMENTS

| | | | |
|---|---|---|---|
| 875307 | 4/1953 | Germany | 292/262 |
| 85282 | 1/1936 | Sweden | 292/262 |
| 185193 | 9/1963 | Sweden | 16/82 |
| 1160277 | 8/1969 | United Kingdom | 292/262 |

*Primary Examiner*—Lloyd A. Gall
*Attorney, Agent, or Firm*—Keith A. Cushing

[57] ABSTRACT

A door security device allows partial opening of a door by coupling a door to a floor structure. The coupling is provided by a door bar including first and second length portions in spaced, parallel relation. The first and second length portions are interconnected by a coupling portion perpendicular thereto. One length portion is pivotally mounted in a floor on the inside of a doorway. The other length portion then assumes an upstanding vertical position. As the door opens, the door engages the upstanding length portion and moves towards an open position so long as the door bar permits. Eventually, the door bar blocks further opening of the door and maintains the door in a secure condition despite partial opening. In a second mode of use, the door bar is reoriented and inserted within the pivotal mounting of the floor to pin the door shut in closed condition. The door security device offers advantage in its ease of installation and use, low cost, and effective security against forced entry.

8 Claims, 1 Drawing Sheet

DOOR SECURITY DEVICE ALLOWING PARTIAL DOOR OPENING

This application is a continuation of application Ser. No. 08/042,038, filed Apr. 1, 1993, now abandoned.

BACKGROUND OF THE INVENTION

The present invention relates generally to door security devices, and particularly to door security devices allowing partial opening of a door while maintaining protection against forced entry.

Residential door security is essential. Every residence has locking doors barring unauthorized entry, especially forced entry. The greater protection against forced entry, the greater the security enjoyed by the inhabitants. Extra security devices, beyond a latch set and dead bolt, are often used once the occupants are inside the building. Such devices are not accessible from the outside and, therefore, are less vulnerable to compromise from the outside. In many situations it is desirable to allow partial opening of the door, but retain protection against forced entry. Door chains selectively couple the door to the surrounding frame to allow partial opening of the door while maintaining some degree of security. Door chains, however, lack good security because of the typically weak attachment of the chain components to the door and surrounding door frame. Once the door is open, the chain itself can be easily broken, or can be broken away from the door or from the door frame.

SUMMARY OF THE INVENTION

A door security device under the present invention includes a pivot support mounted adjacent a door and defining an axis of rotation. A pivot bar includes a first length portion pivotally supported by the pivot support and a second length portion in spaced relation to the first length portion. As the door begins to open, the second length portion engages the door and causes the device to pivot about its axis of rotation. Eventually, the device blocks further opening of the door, but maintains a high degree of security against forced entry. In a preferred embodiment of the present invention, the first length portion is mounted vertically near a door threshold and the second length portion assumes an upstanding orientation to engage the bottom edge of the door. By coupling the door to the relatively more fortified floor structure, as compared to a surrounding frame structure, the device of the present invention improves door security. In a second mode of operation, the security device may be used to pin the door shut in its closed position without allowing partial opening of the door.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF THE PREFERRED EMBODIMENT

The present invention provides a door security device placed in operation from the inside and generally intended as a supplement to ordinary door security devices such as latch sets and dead bolts. The device finds advantage in its ease of installation and use, low cost, and effective security against forced entry.

Figure 1:
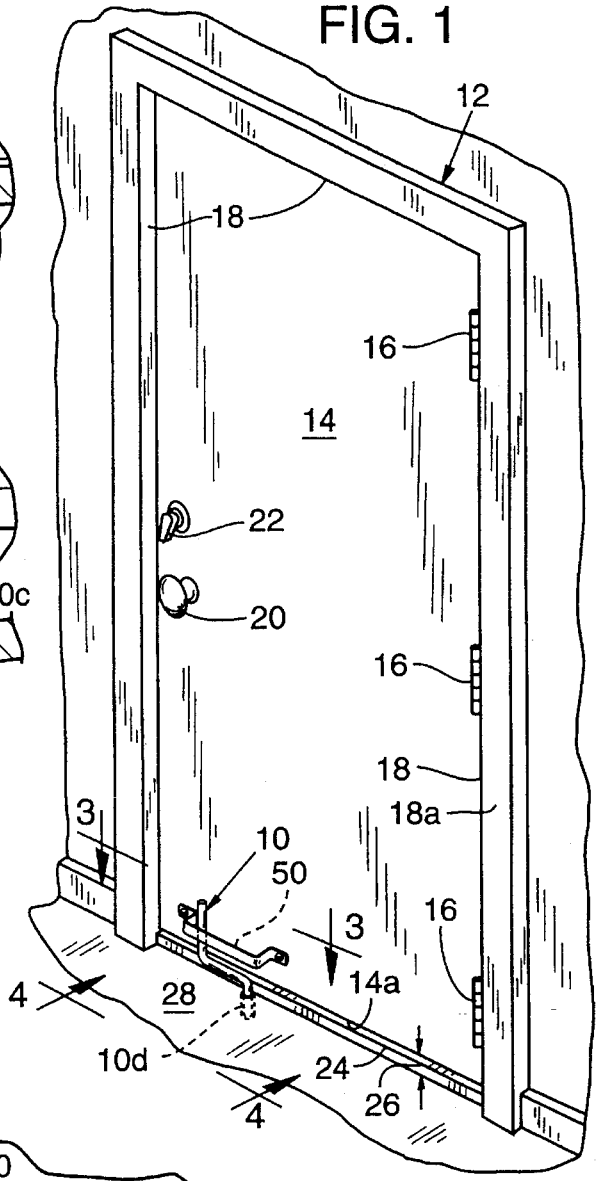
FIG. 1 is a perspective view of a doorway including a door security device according to a preferred embodiment of the present invention.

FIG. 1 illustrates a preferred embodiment of the present invention, a door bar 10 securing a conventional doorway 12. Doorway 12 includes a door 14 resting upon hinges 16 within a door frame 18. Door 14 carries a conventional locking entry latch set 20 and dead bolt 22 securing door 14 in its closed position within door frame 18. Latch set 20 and dead bolt 22 secure door 14 to the frame 18 to the extent that hinges 16, latch set 20 and dead bolt 22 are secured to the frame 18. Frame 18 includes a threshold 24 defining a vertical separation 26 between the lower edge 14*a* of door 14 and a floor 28, specifically floor surface 28*a*, on the inner side 18*a* of frame 18. Door 14 is secured in its fully closed position so long as latch set 20 and dead bolt 22 remain engaged in frame 18. Once latch set 20 and dead bolt 18 are unlocked, however, door 14 can pivot on hinges 16 away from its fully closed position.

The door bar 10 couples door 14 to floor 28 and holds door 14 against pivoting open. In a first mode of use (FIGS. 1 and 3–5), door bar 10 allows partial opening of door 14 following release of latch set 20 and dead bolt 22. More particularly, door bar 10 allows door 14 to open several inches, but maintains coupling between door 14 and floor 28. As may be appreciated, floor 28 is better suited to resist forced entry than frame 18. Coupling door 14 to the better fortified floor 28 thereby enhances protection against forced entry through doorway 12.

Figure 2:
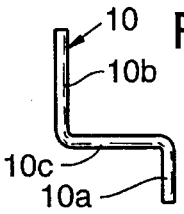
FIG. 2 illustrates separately a door bar of the door security device of FIG. 1.

FIG. 2 illustrates the door bar 10 separately from the doorway 12. In FIG. 2, door bar 10 includes a first length portion 10*a* and a second length portion 10*b*. Length portions 10*a* and 10*b* are in spaced, parallel relation and rigidly interconnected by coupling length portion 10*c*. In the preferred embodiment of the present invention, portion 10*c* is perpendicular to portions 10*a* and 10*b*. Door bar 10 may be constructed from a variety of materials, but preferably of a unitary body of rigid material capable of resisting deformation.

Returning to FIG. 1, door bar 10 rests pivotally within a support collar 10*d* buried in floor 28 below surface 28*a*. Collar 10*d* may be secured to floor 28 by first drilling a hole corresponding in depth to the length of collar 10*d*. The inner diameter of collar 10*d* closely matches the outer diameter of length portion 10*a* to allow free pivoting of length portion 10*a* within collar 10*d*. In such pivotal mounting to the floor 28, the length portion 10*c* moves within a horizontal plane immediately adjacent surface 28*a* of floor 28. The length portion 10*b* assumes a vertical orientation above floor surface 28*a* and orbits about the axis of rotation defined by collar 10*d*. The vertical dimension of length portion 10*c* is less than the vertical separation 26 between lower edge 14*a* of door 14 and floor surface 28*a* to allow partial opening of door 14, i.e., allow door 14 to pass over the horizontally disposed length portion 10*c*. With the collar 10*d* positioned immediately inside the threshold 24, however, the length portion 10*b* blocks full opening of the door 14.

Figure 3:
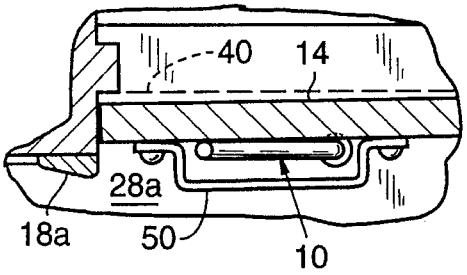
FIG. 3 is a top sectional view of the doorway and door security device of FIG. 1 as taken along lines 3—3 of FIG. 1.
Figure 5:
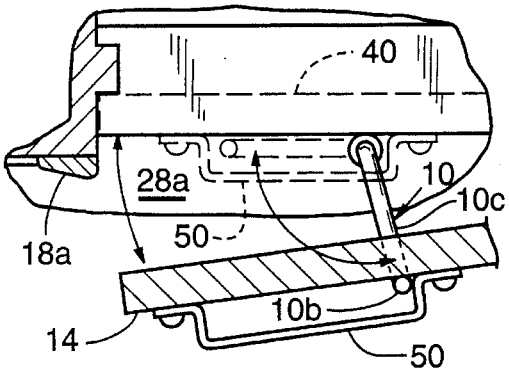
FIG. 5 is a top sectional view similar to FIG. 3, but showing operation of the door security device of FIG. 1 allowing secure partial opening of the doorway.
Figure 4:
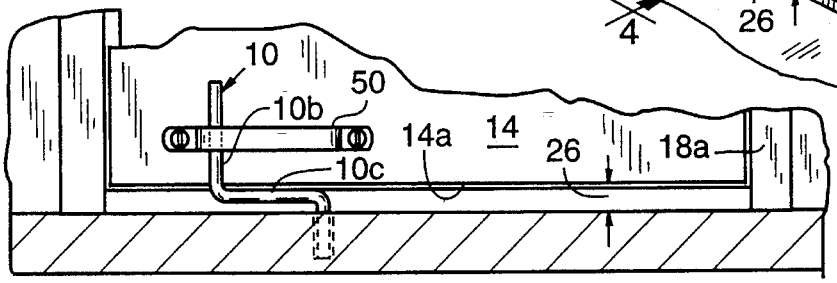
FIG. 4 is a face view detailing the doorway and door security device of FIG. 1.

In FIG. 3, door 14 is shown moving slightly from its closed position 40. It is assumed that latch set 20 and dead bolt 22 have been released and door 14 is just beginning to open. Door 14 immediately passes over length portion 10*a* and collar 10*d*. As shown in FIG. 4, the vertical separation 26 between lower edge 14*a* of door 14 and floor surface 28*a* is sufficient to accommodate the length portion 10*c* of door bar 10. As door 14 continues to open, it engages the upstanding length portion 10*b* and causes door bar 10 to pivot within the collar 10*d* until such time that door 14 reaches the position shown in FIG. 5, i.e., when the length portion 10*c* becomes normal to the plane of door 14. Further urging of door 14 towards an opened position is blocked by door bar 10. As may be appreciated, while the door bar 10 may be visible to a person on the outside of door 14 as indicated in FIG. 5, door bar 10 is captured within collar 10*d* by virtue of the positioning of door 14 over the length portion 10*c*. In other words, it would be impossible for an intruder to disable the door security device 10 even with door 14 open as shown in FIG. 5.

Figure 6:
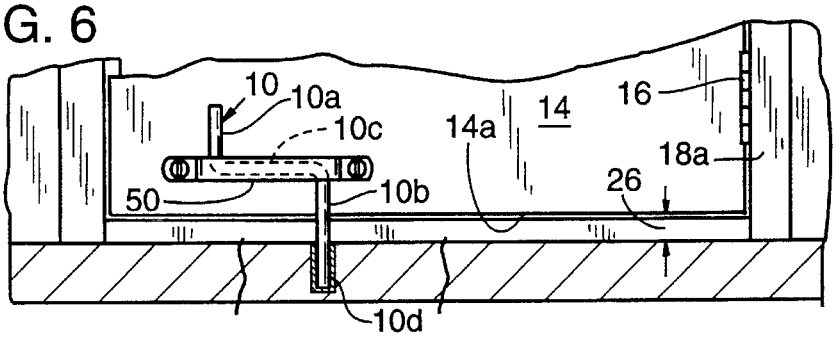
FIG. 6 is a face view of the door security device of FIG. 1 in an alternative mode of operation pinning the door in a closed position.

In a second mode of use, door bar 10 augments security provided by latch set 20 and dead bolt 22 by preventing door 14 from moving beyond its closed position. In FIG. 6, door bar 10 is shown in its second mode of use. The length portion 10*b* is inserted within collar 10*d*. Because length portion 10*b* is longer than the combined vertical separation 26 and depth of collar 10*d*, length portion 10*b* extends vertically above the lower edge 14*a* of door 14. Accordingly, door bar 10 in this mode of use pins shut door 14 in its closed position. Door bar 10 thereby augments security provided by latch set 20 and dead bolt 22 in their locked positions. As may be appreciated, coupling door 14 to floor 28 in the manner illustrated in FIG. 6 can only improve resistance against forced entry.

Door security device 10 may further include a bracket 50 providing a generally rectangular space between itself and door 14 in the vicinity of collar 10*d* when door 14 is shut. The bracket 50 may be attached directly to the door 14. Bracket 50 maintains door bar 10 against door 14. This keeps door bar 10 from inadvertently pivoting away from door 14 in its closed position and presenting risk of injury to persons. For example, a person could either trip on door bar 10 or fall upon door bar 10 with resulting injury. Thus, in the first mode of use, bracket 50 maintains the upstanding portion 10*b* adjacent the door 14. In the second mode of use, bracket 50 captures portion 10*c* against door 14 and prevents any pivoting of door bar 10. By appropriate dimensioning of the portions 10*a*–10*c* and vertical positioning of bracket 50, the portion 10*c* lies within the rectangular space of bracket 50 in the second mode of use. As may be appreciated, the bracket 50 does not necessarily enhance the security provided by door bar 10, rather is provided primarily as an alternative or optional safety feature. It is contemplated, however, that should the door bar 10 begin to bend under forced entry of door 14, the bracket 50 would aid in resisting further bending of door bar 10.

The preferred form of the present invention provides a stainless steel door bar 10 constructed by bending of 7/16 inch diameter round stock with portion 10*a* of 2¼ inches length, portion 10*b* of 5 inches length, and portion 10*c* of 4 inches length. The depth or length of collar 10*d* is selected to accommodate full insertion of the length portion 10*a* within collar 10*d*, but not full insertion of length portion 10*b*, in the preferred embodiment collar 10*d* provides a depth of 2½ inches. The angular relationship between length portion 10*a* and length portion 10*c* is preferably as close as possible to perpendicular. This allows the length portion 10*c* to move in a horizontal plane closely above the surface 28*a* of floor 28 and within the vertical separation 26.

In overall operation, door bar is used from the inside of door 14. When operated in its first mode of use allowing partial, but secure, opening of door 14 the length portion 10*a* is inserted into collar 10*d*. It is contemplated that latch set 20 and dead bolt 22 remain in their locked positions. If a visitor comes to doorway 12 and the occupant wishes to view the visitor or exchange a package with the visitor, the latch set 20 and dead bolt 22 may be released and door 14 partially opened while maintaining a coupling between door 14 and floor 28, i.e., blocking door 14 against full opening by use of door bar 10. As may be appreciated, the occupant can leave door bar 10 in its second mode of use, pinning door 14 in its shut position, but switch to the first mode of use prior to unlocking the latch set 20 and dead bolt 22 when secure partial opening of door 14 is desired. In its second mode of use, door bar 10 pins door 14 in its shut position to enhance the security provided by door 14. It is contemplated that pinning the door 14 in this manner to the more substantial floor 28 provides a more secure doorway. A floor structure can be substantially more fortified relative to a door frame. For example, floor 28 may include more substantial material, i.e., larger dimensioned and interconnected wood elements, or more substantial material such as concrete. To the extent that collar 10d may be better fortified within the floor 28, enhanced security is provided by the door bar 10.

Thus, a door security device allowing partial door opening has been shown and described. The device is simple to use, yet provides significant security features. It is contemplated that the invention may be provided as a kit consisting of the collar 10*d*, door bar 10, and bracket 50. Purchasers of the kit need only drill a hole in a floor adjacent a doorway to be secured and insert the collar 10*d*. The bracket 50 may then be secured to the doorway in appropriate position and installation is complete. The user switches between the first and second modes of use by merely removing and reorienting door bar 10 according to the selected mode. To fully open the door, the user simply removes door bar 10 from collar 10*d*.

It will be appreciated that the present invention is not restricted to the particular embodiment that has been described and illustrated, and that variations may be made therein without departing from the scope of the invention as found in the appended claims and equivalents thereof.

What is claimed is:

1. In combination, a security device and a door, the security device comprising:

a pivot support mountable adjacent said door and defining an axis of rotation, said axis of rotation being spaced from an arcuate path of a vertical edge of said door by a given distance; and a one-piece pivot bar having a first length portion arranged substantially parallel to a hinge axis of said door pivotally supported by said pivot support and having a second length portion coupled to said first length portion in spaced relation to said axis of rotation no greater than said given distance whereby said second length portion engages directly said door at a free end of said second length portion and rotates about said axis of rotation upon partial opening of said door to a given point, but beyond said given point ceases rotating about said axis and blocks further opening of said door, said first length portion being collinear with said axis of rotation, said first and second length portions extending in opposite and substantially parallel directions from said pivot bar, said first length portion being freely removable from said pivot support along said axis when said door is closed and blocked against removal along said axis when said door is partially open to said given point.

2. A combination according to claim 1 wherein said pivot support is mountable to a floor structure adjacent said door.

3. A combination according to claim 1 wherein said given point is a function of the spaced relation between said first and second length portions along a dimension transverse to said axis of rotation.

4. A combination according to claim 1 wherein said pivot bar comprises first and second length portions maintained in parallel and non-collinear relation by a coupling portion therebetween.

5. A combination according to claim 4 wherein said coupling portion is orthogonal to said first and second length portions.

6. In combination, a door security device and a doorway, the doorway including a door with a lower edge, a hinged edge, and an opposite edge parallel to said hinged edge, said doorway further including a threshold defining a vertical separation between the door lower edge and a floor adjacent said doorway, the door security device comprising:

a pivot collar mountable vertically within said floor adjacent said doorway and defining a vertical axis of rotation; and a one-piece security bar including first and second length portions and a coupling portion rigidly maintaining said first and second length portions in parallel and non-collinear relation, the first length portion being insertable within said collar and rotatable about said axis of rotation whereby said second length portion assumes a vertical upstanding orientation orbiting about said axis of rotation and directly engaging a face of said door which substantially faces a direction in which said door swings, in such manner that said door may partially open to a given point with said coupling portion positioned within said vertical separation but at said given point said second length portion blocks further opening of said door, said first and second length portions extending in opposite directions from said coupling portion, said axis of rotation being spaced from said opposite edge by at least a distance at least as great as a length of said coupling portion.

7. A combination according to claim 6 wherein said given point coincides with said coupling portion assuming a substantially 90 degree relation to a plane containing said door.

8. A combination according to claim 6 wherein said collar is positionable more closely to said opposite edge of said door most distant from said hinged edge.

* * * * *